US008074384B2

(12) United States Patent
Kuwabara

(10) Patent No.: US 8,074,384 B2
(45) Date of Patent: Dec. 13, 2011

(54) AUXILIARY TOOL FOR HANDCRAFTING

(75) Inventor: Junichi Kuwabara, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 533 days.

(21) Appl. No.: 12/300,691

(22) PCT Filed: May 23, 2007

(86) PCT No.: PCT/JP2007/060488

§ 371 (c)(1),
(2), (4) Date: Nov. 13, 2008

(87) PCT Pub. No.: WO2007/138943

PCT Pub. Date: Dec. 6, 2007

(65) Prior Publication Data

US 2009/0107017 A1 Apr. 30, 2009

(30) Foreign Application Priority Data

May 25, 2006 (JP) ..... 2006-145853

(51) Int. Cl.
*D06C 3/08* (2006.01)
*G09B 19/20* (2006.01)
*A41H 3/00* (2006.01)

(52) U.S. Cl. ..... 38/102.2; 33/13; 434/95

(58) Field of Classification Search ..... 112/169, 112/227, 1, 475.17, 153; 33/1 G, 2 R; 434/95; 38/102.2, 102.91
See application file for complete search history.

(56) References Cited

U.S. PATENT DOCUMENTS

| | | | | |
|---|---|---|---|---|
| 2,077,772 | A * | 4/1937 | Ring | 33/13 |
| 2,088,455 | A * | 7/1937 | Witt | 28/150 |
| 2,574,064 | A * | 11/1951 | Rosen | 434/95 |
| 2,585,946 | A * | 2/1952 | Liberman | 434/95 |
| 2,957,269 | A * | 10/1960 | Nohl et al. | 38/102.2 |
| 2,986,390 | A * | 5/1961 | Kelly | 269/2 |
| 4,411,208 | A | 10/1983 | Nishida et al. | |
| 4,485,574 | A | 12/1984 | Bennetot | |
| 4,608,939 | A * | 9/1986 | Lampley | 112/260 |
| 6,155,189 | A * | 12/2000 | Walner | 112/475.01 |
| 2008/0000116 | A1 * | 1/2008 | Last | 40/124.01 |

FOREIGN PATENT DOCUMENTS

| | | |
|---|---|---|
| JP | 58-48391 | 11/1983 |
| JP | 61-389 | 1/1986 |
| JP | 3-2983 | 1/1991 |
| JP | 2759319 | 3/1998 |
| JP | 2004-169238 | 6/2004 |

* cited by examiner

*Primary Examiner* — Ismael Izaguirre
(74) *Attorney, Agent, or Firm* — Hamre, Schumann, Mueller & Larson, P.C.

(57) ABSTRACT

A handicraft assisting tool (1) includes a plate-like holding member (3) and a supporting member (2) on which the holding member is placed. The supporting member (2) includes a main plate having a shape corresponding to the holding member (3) and a side plate (22) standing from the periphery of the main plate in the thickness direction of the main plate. The main plate is formed with a plurality of elongated holes (23) arranged adjacent to the periphery of the main plate and spaced from each other along the periphery. The holding member (3) includes a periphery formed with a plurality of recesses (33). Each of the elongated holes (23) includes opposite ends configured to communicate with the recesses (33) when the holding member (3) is placed on the supporting member (2).

12 Claims, 14 Drawing Sheets

AUXILIARY TOOL FOR HANDCRAFTING

TECHNICAL FIELD

The present invention relates to an auxiliary assisting tool used in the field of handicraft such as patchworking.

BACKGROUND ART

Conventionally, in the field of handicraft such as patchworking, various tools for facilitating the making of handicraft have been proposed. For instance, Patent Document 1 given below discloses a pattern set for facilitating the work of cutting cloth in making a patchwork.

Patent Document 1: JP-A-2004-169238

A yo-yo quilt is known as one of patchwork quilts which has excellent decoration effect. A yo-yo quilt is made using e.g. a plurality of circular quilt parts (yo-yos). To make a yo-yo quilt, a plurality of yo-yos are first formed. A yo-yo is formed by folding back the edge of circular cloth, sewing the cloth along folded edge and then pulling and knotting the thread tightly. As shown in FIG. 19 of the present application, the yo-yo made in this way has a circular shape formed with gathers on the front side. By connecting a plurality of such yo-yos by sewing the respective edges together or sewing the connected yo-yos onto cloth as the base, a yo-yo quilt is completed.

Yo-yo quilts require a large number of yo-yos depending on the design, and to make a large number of yo-yos may be a burden. Further, to make a large number of yo-yos of uniform size and gathers requires experiences and skills.

DISCLOSURE OF THE INVENTION

The present invention has been proposed under the above-described circumstances. It is, therefore, an object of the present invention to provide a handicraft assisting tool which makes it possible to make quilt parts such as yo-yos easily and efficiently.

To solve the above-described problems, the present invention takes the following technical measures.

A handicraft assisting tool provided according to the present invention comprises a holding member in the form of a plate and a supporting member on which the holding member is to be placed. The supporting member includes a main plate having a shape corresponding to the holding member, and a side plate standing from the periphery of the main plate in the thickness direction of the main plate. The main plate is formed with a plurality of elongated holes arranged along the periphery of the main plate and spaced from each other. The holding member includes a periphery formed with a plurality of recesses. Each of the elongated holes includes opposite ends which communicate with the recesses when the holding member is placed on the supporting member.

Preferably, the handicraft assisting tool of the present invention further comprises a movement preventer for preventing the movement of the holding member relative to the supporting member in the thickness direction.

Preferably, the periphery of the holding member is formed with a needle-guiding surface adjoining the recess.

Preferably, each of the elongated holes includes a middle portion connecting the opposite ends to each other, and the middle portion projects radially inward of the supporting member.

Preferably, the elongated holes have the same size, and the distance between the opposite ends of each of the elongated holes is equal to the distance between adjacent ones of the elongated holes.

Preferably, the supporting member is formed with a through-hole penetrating through the center of the supporting member in the thickness direction.

Preferably, the periphery of the holding member is formed with an inclined surface. When the holding member is placed on the supporting member, the inclined surface is so inclined as to come closer to the main plate of the supporting member as proceeding radially outward of the holding member.

In the present invention, the main plate of the supporting member may be either circular or non-circular.

Other features and advantages of the present invention will become more apparent from the detailed description given below with reference to the accompanying drawings.

BRIEF DESCRIPTION OF THE DRAWINGS

FIG. 1A is an exploded perspective view showing a supporting member and a holding member constituting a handicraft assisting tool according to a first embodiment of the present invention, whereas

BEST MODE FOR CARRYING OUT THE INVENTION

Preferred embodiments of the present invention will be described below with reference to the accompanying drawings.

Figure 1A:
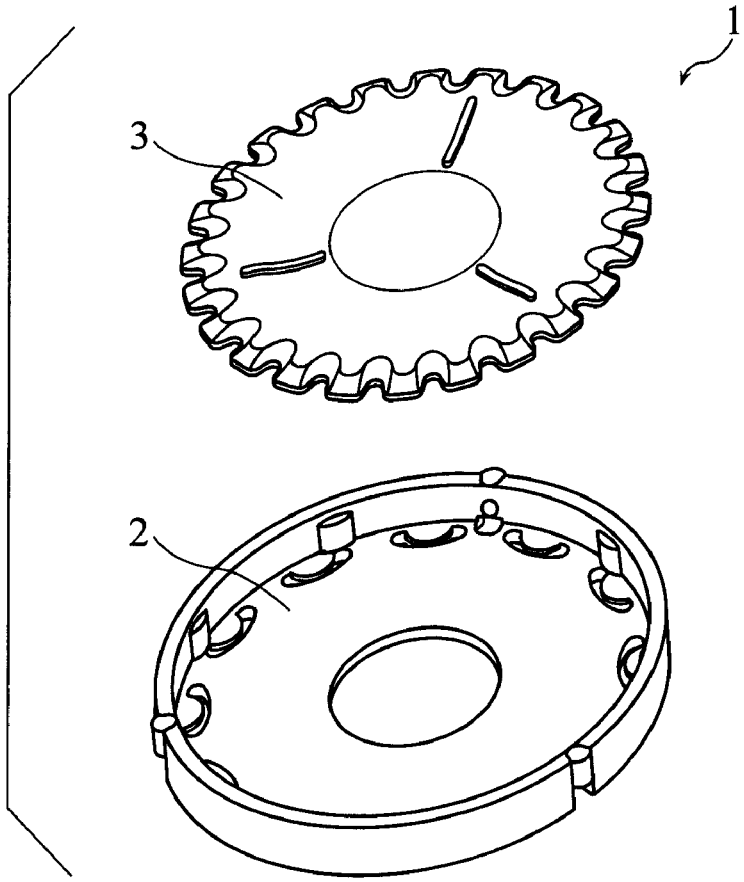
Figure 1B:
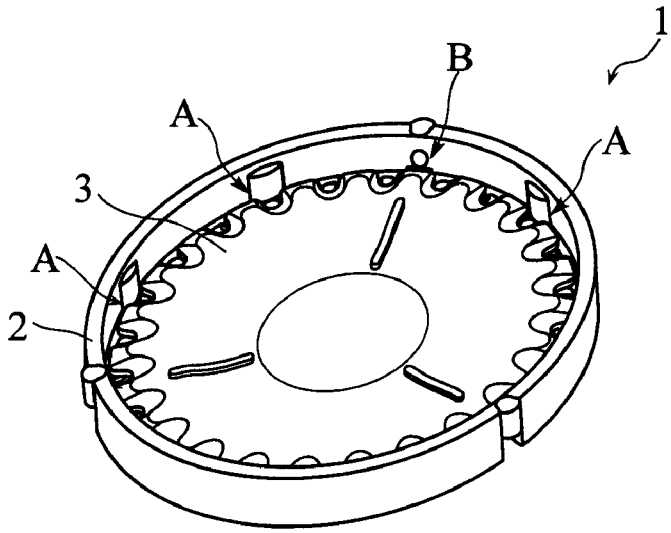
FIG. 1B shows the "assembled state" in which the holding member is set to the supporting member.

FIGS. 1A and 1B show a handicraft assisting tool according to a first embodiment of the present invention. The handicraft assisting tool includes a supporting member 2 and a holding member 3. The handicraft assisting tool 1 further includes a rotation preventing mechanism A and a lock mechanism B, which will be described later. The handicraft assisting tool 1 is used for making a circular quilt part (yo-yo).

Figure 2:
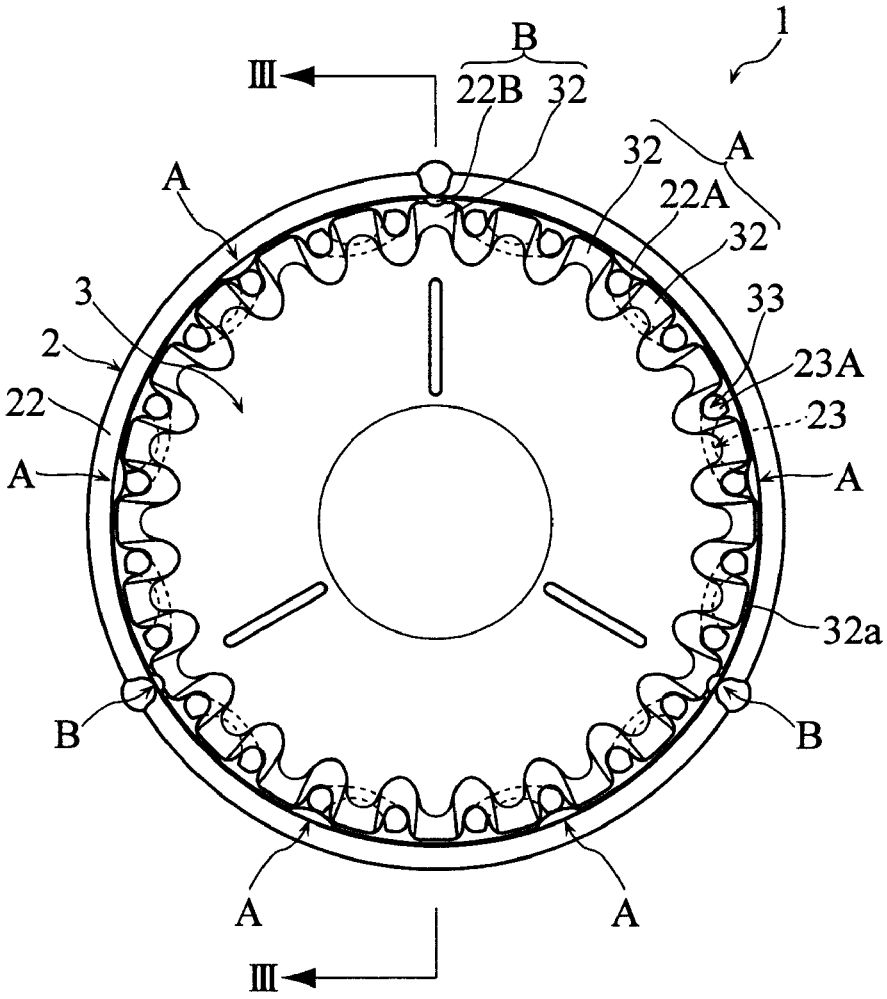
FIG. 2 is a plan view showing the assembled state.
Figure 3:
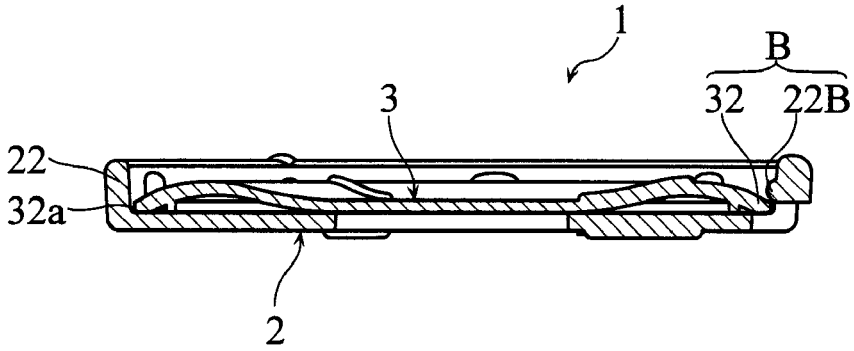
FIG. 3 is a sectional view taken along lines III-III in FIG. 2.

FIG. 1B shows the state in which the holding member 3 is properly placed on the supporting member 2. (Hereinafter, this state is referred to as "assembled state".) In the actual use of the handicraft assisting tool 1 for making a yo-yo, material cloth is sandwiched between the supporting member 2 and the holding member 3 (see FIGS. 12 and 13). FIG. 2 is a plan view showing the assembled state. FIG. 3 is a sectional view taken along lines III-III in FIG. 2.

Figure 4:
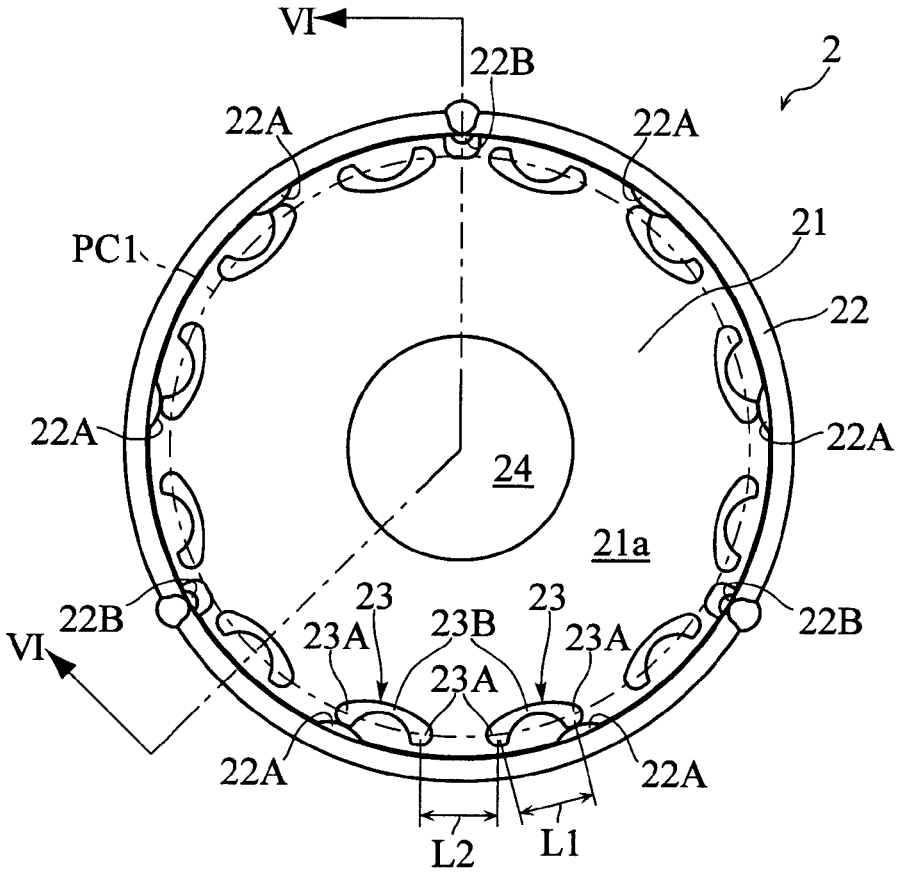
FIG. 4 is a plan view of the supporting member.
Figure 5:
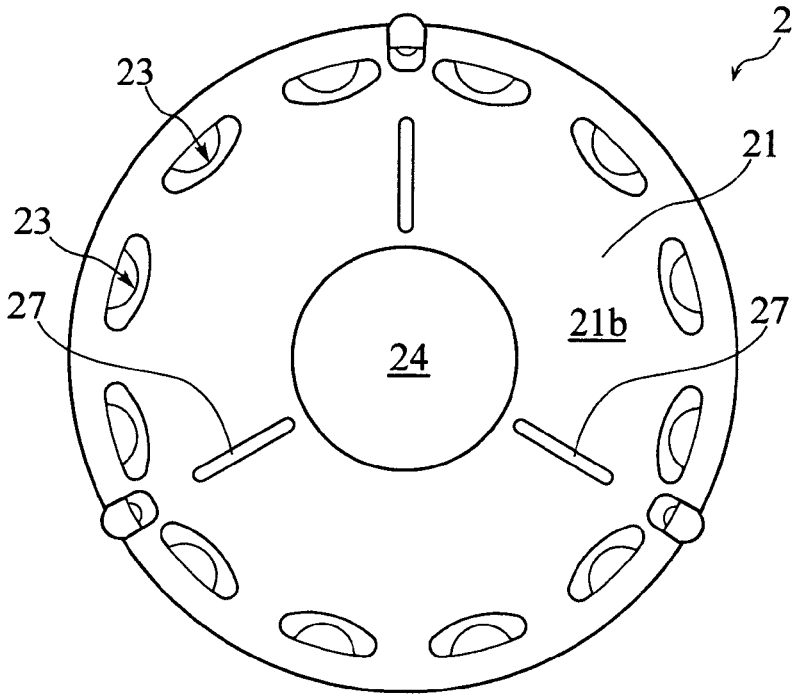
FIG. 5 is a rear view of the supporting member.
Figure 6:
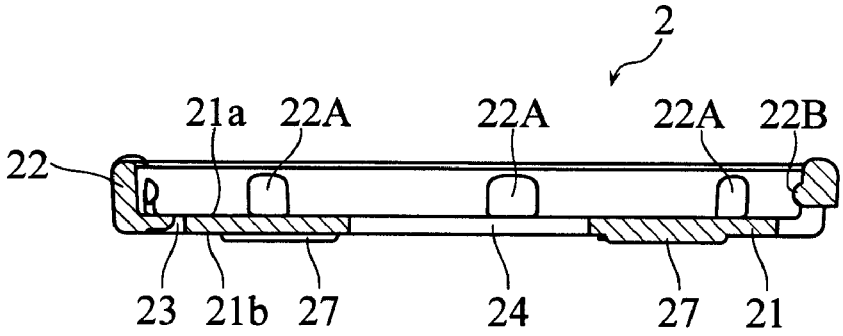
FIG. 6 is a sectional view taken along lines VI-VI in FIG. 4.

FIGS. 4-6 show the supporting member 2. As shown in the figures, the supporting member 2 includes a circular main plate 21 and a cylindrical side plate 22. The main plate 21 and the side plate 22 are made of a synthetic resin having certain strength such as polypropylene to be integrally with each other.

The main plate 21 is formed with a plurality of elongated holes 23 and a through-hole 24. The main plate 21 has a certain thickness and includes a flat inner surface 21*a* on which the holding member 3 is to be placed. As shown in FIG. 5, the main plate 21 includes an outer surface 21*b* formed with a plurality of radially extending projections 27. The projections 27 are equally spaced from each other in the circumferential direction of the main plate 21.

The side plate 22 extends from the periphery of the inner surface 21*a* of the main plate 21 in the thickness direction of the main plate to have a predetermined height. The diameter of the inner circumferential surface of the side plate 22 is so set that the holding member 3 is accommodated within the side plate.

As shown in FIG. 4 or 5, the elongated holes 23 are formed adjacent to the periphery of the main plate 21 and spaced from each other at predetermined intervals. Each of the elongated holes 23 extends in the circumferential direction of the main plate 21. The elongated holes 23 have the same size and shape. Each of the elongated holes 23 has two ends 23A and a middle portion 23B connecting the two ends to each other. The middle portion 23B curves to project inward in the radial direction of the supporting member 2. Each end 23A of the elongated hole 23 is arcuate and has a dimension which allows smooth passing of a sewing needle. The diameter of the end 23A depends on the thickness of the needle to be used and may be about 2 mm, for example. As shown in FIG. 4, the center of each arcuate end 23A is located on a pitch circle PC1. The distance (dimension L1 in FIG. 4) between the two ends 23A of each elongated hole 23 is equal to the distance (dimension L2 in FIG. 4) between adjacent ends 23A of two different elongated holes 23. That is, the ends 23A of the elongated holes 23A are arranged at equal intervals on the pitch circle PC1.

As shown in FIGS. 4 and 6, the inner circumferential surface of the side plate 22 is formed with a plurality of rotation preventing projections 22A and locking projections 22B. Each of the rotation preventing projections 22A comprises part of a column extending from the inner surface 21*a* of the main plate 21 to a position adjacent to the upper end of the side plate 22 in the height direction (vertical direction in FIG. 6) of the side plate 22. As shown in FIG. 4, the rotation preventing projection 22A is provided adjacent to one end 23A of the elongated hole 23. Each of the locking projections 22B comprises part of a sphere projecting from an intermediate portion of the side plate 22 in the height direction. As shown in FIG. 4, the locking projection 22B is provided at the midpoint between two adjacent elongated holes 23. The functions of the projections 22A and 22B will be described later.

In the assembled state (i.e., the state in which the holding member 3 is properly placed on the supporting member 2), the holding member 3 can be pushed with a finger through the through-holes 24. Thus, the through-hole 24 facilitates the removal of the holding member 3 from the supporting member 2. As shown in FIGS. 4 and 5, the through-hole 24 is formed at the center of the main plate 21. For instance, the through-hole 24 may have a size which allows the insertion of a thumb, and the diameter may be about 2 cm.

Figure 7:
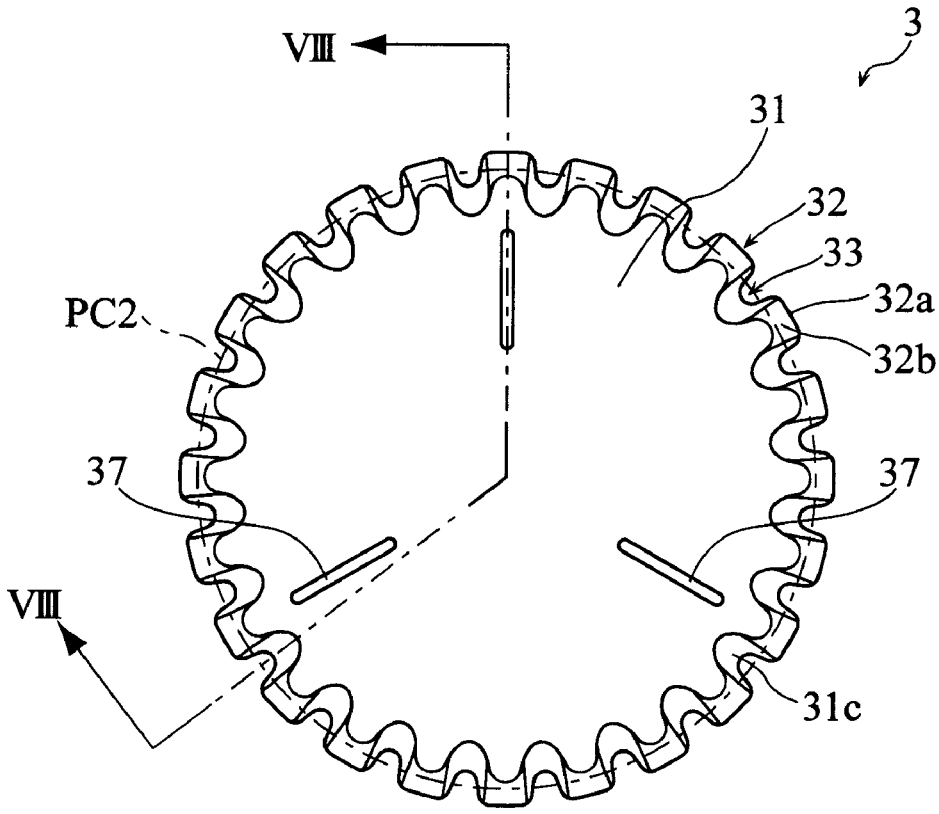
FIG. 7 is a plan view of the holding member.
Figure 8:
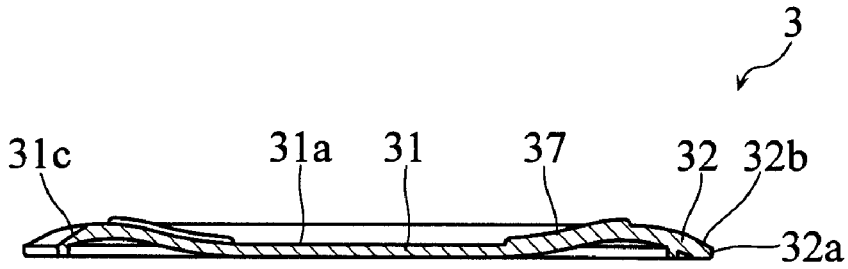
FIG. 8 is a sectional view taken along lines VIII-VIII in FIG. 7.

As shown in FIGS. 7 and 8, the holding member 3 is in the form of a gear comprising a plate portion 31 which is generally circular in plan view and a plurality of projections 32 formed at the periphery of the plate portion. A recess 33 is defined between adjacent ones of the projections 32. The holding member 3 may be made of a synthetic resin such as polypropylene.

As shown in FIG. 8, the periphery of the plate portion 31 bulges to one side (upper side in FIG. 8) in the thickness direction. The upper surface 31*a* of the plate portion 31 is formed with a plurality of linear projections 37 extending radially. The linear projections 37 are equally spaced from each other in the circumferential direction.

The projections 32 of the holding member 3 are equally spaced from each other. The edge (outer edge 32*a*) of each projection 32 is generally arcuate. In the assembled state (see FIG. 2), the edge extends along the inner circumferential surface of the side plate 22 of the supporting member 2 at a slight distance from the surface. As shown in FIG. 8, the projection 32 is formed with an inclined surface 32*b*. In the assembled state, the surface 32*b* is so inclined as to come closer to the main plate 21 of the supporting member 2 as proceeding radially outward of the holding member 3.

The recesses 33 are defined by the edges of the plate portion 31 which are located radially inward relative to the outer edges 32*a* of the projections 32. In the above-described assembled state, the recesses 33 communicate with the ends 23A of the elongated holes 23 of the supporting member 2. To achieve this, the recesses 33 are arranged on a pitch circle PC2 having the substantially same size as that of the pitch circle on which the ends 23A of the elongated holes 23 are arranged. Further, the distance between adjacent recesses 33 is set substantially equal to the distance between adjacent ends 23A of the elongated holes 23. As shown in FIG. 8, the holding member is formed with inclined needle-guiding surfaces 31*c* adjacent to the respective recesses 33. Each of the needle-guiding surfaces 31*c* may be defined by a groove dented toward the lower surface of the holding member 3.

Figure 9:
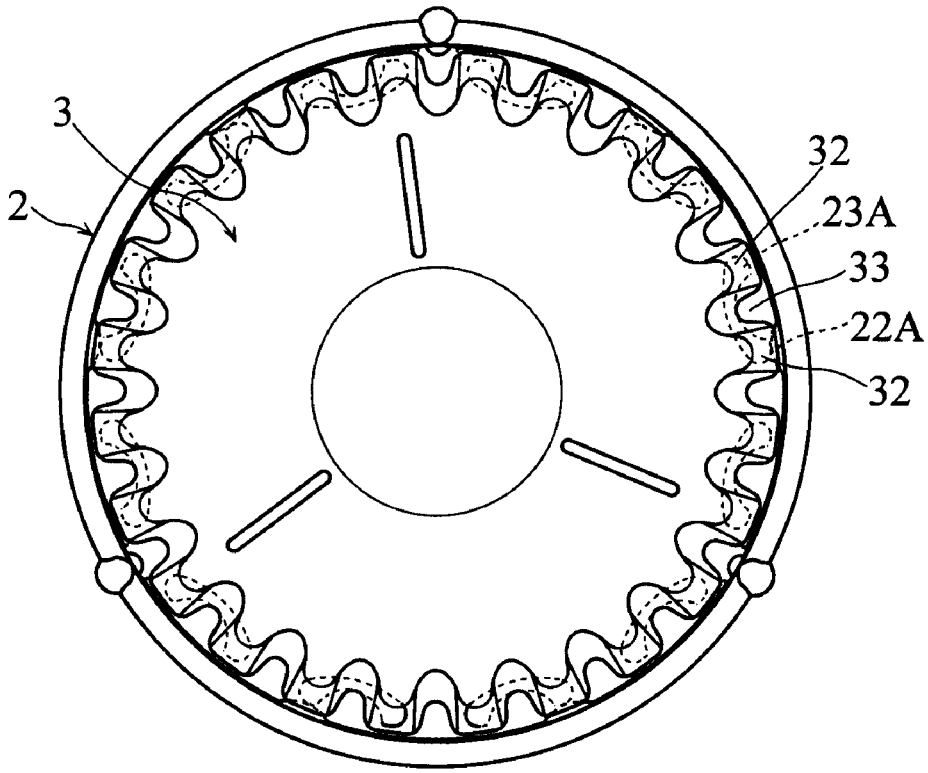
FIG. 9 is a plan view showing the process of placing the holding member on the supporting member.

The rotation preventing mechanism A serves to prevent the holding member 3 from rotating relative to the supporting member 2 in the assembled state. As shown in FIG. 2, in this embodiment, the rotation preventing projections 22A of the supporting member 2 and the recesses 33 of the holding member 3 constitute the rotation preventing mechanism A. As will be understood from the figure, in the assembled state, the rotation preventing projections 22A engage with the recesses 33 to prevent the rotation of the holding member 3. In this state in which the rotation is prevented, the ends 23A of the elongated holes 23 of the supporting member 2 communicate with the recesses 33 of the holding member 3. The state which is different from this is shown in FIG. 9. In the state shown in the figure, the positional relationship between the holding member 3 and the supporting member is such that the ends 23A of the elongated holes 23 do not communicate with the recesses 33, i.e., the ends 23A of the elongated holes 23 and the projections 32 of the holding member 3 overlap each other. In this state, the rotation preventing projections 22A come into contact with the projections 32 of the holding member 3, so that the holding member 3 cannot be set properly to the supporting member 2. In this way, the rotation preventing projections 22A also function as a guide for properly placing the holding member 3 on the supporting member 2.

Figure 10:
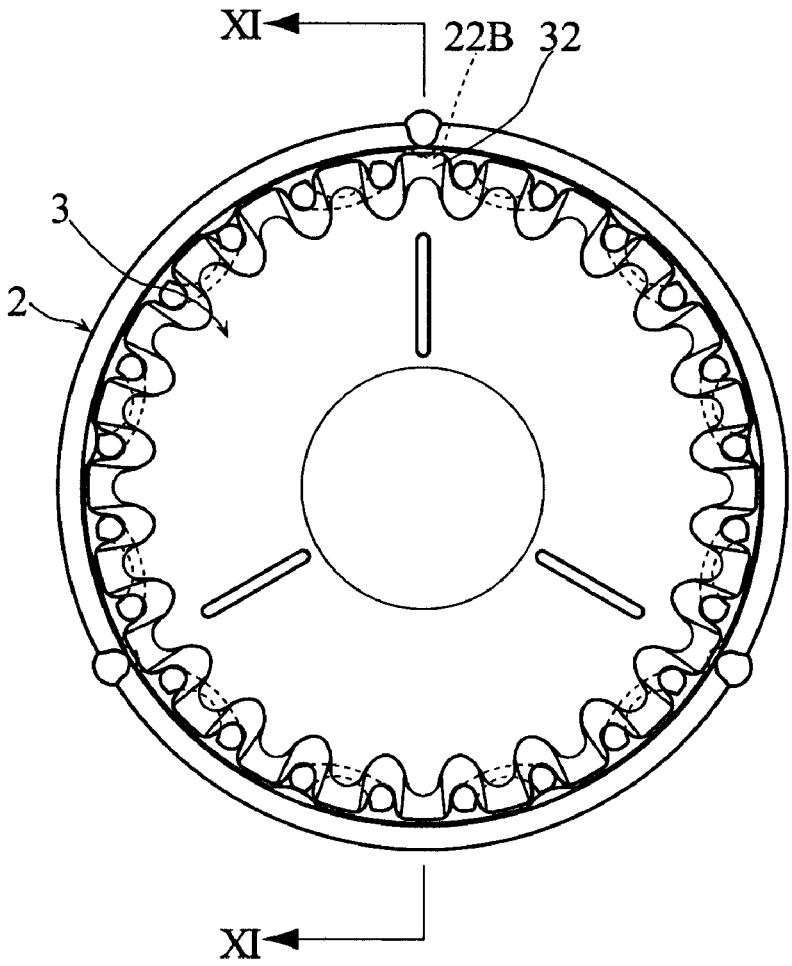
FIG. 10 is a plan view showing the process of placing the holding member on the supporting member.
Figure 11:
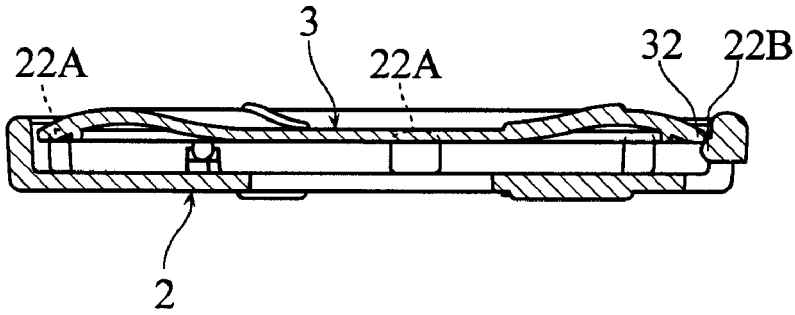
FIG. 11 is a sectional view taken along lines XI-XI in FIG. 10.

In the assembled state, the lock mechanism B prevents the holding member 3 from moving relative to the supporting member 2 in the thickness direction. As shown in FIG. 2, the locking projections 22B of the side plate 22 of the supporting member 2 and the projections 32 of the holding member 3 constitute the lock mechanism B. As shown in FIGS. 10 and 11, in placing the holding member 3 on the supporting member 2, the rotation preventing projections 22A guides the two members to such a positional relationship that the ends 23A of the elongated holes 23 and the recesses 33 of the holding member 3 communicate with each other. In this state, the locking projections 22B contact the projections 32. When the holding member 3 is pressed against the supporting member 2 with a force larger than a certain level, the plate portion 31 and the projections 32 of the holding member 3 are elastically deformed, whereby the projections 32 pass the locking projections 22B. When the projections 32 pass the locking projections 22B, the holding member 3 returns to its original shape. In this way, holding member 3 is set to the supporting member 2. In the assembled state achieved in this way, the movement of the holding member 3 in the thickness direction (upward direction in FIG. 3) is prevented by the engagement of the locking projections 22B and the projections 32.

A method of making a yo-yo using the handicraft assisting tool 1 will be described below with reference to FIGS. 12-18.

Figure 12:
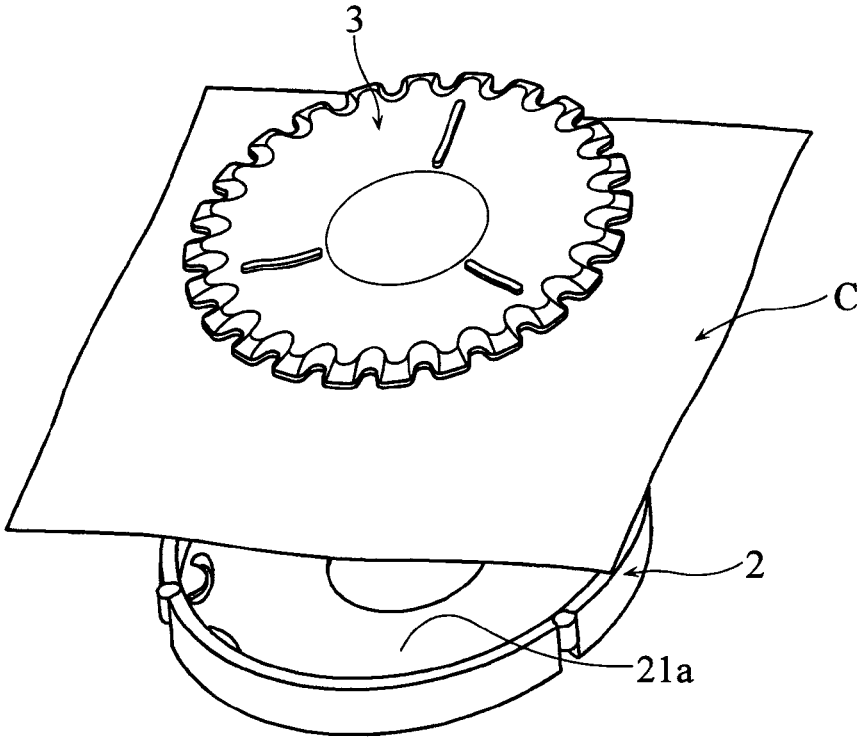
FIG. 12 is a perspective view showing the state in which cloth is arranged between the holding member and the supporting member.
Figure 13:
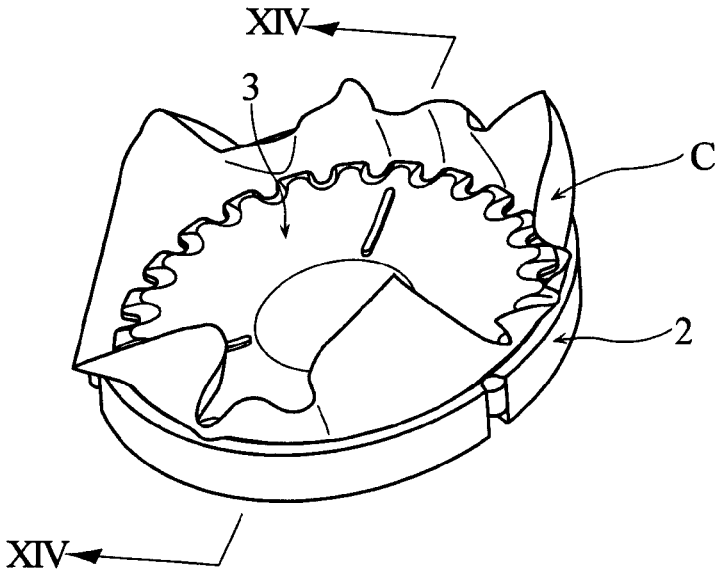
FIG. 13 is a perspective view showing the state in which the holding member is set to the supporting member with the cloth sandwiched.
Figure 14:
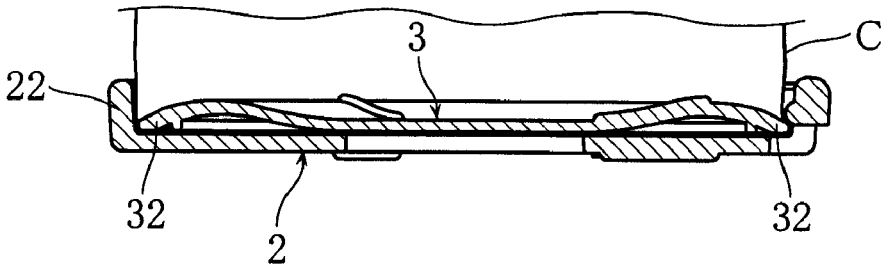
FIG. 14 is a sectional view taken along lines XIV-XIV in FIG. 13.

First, cloth of an appropriate size is prepared. As shown in FIG. 12, the cloth C and the holding member 3 are placed on the supporting member 2. In placing the holding member 3 on the supporting member 2, it is necessary to establish such a positional relationship that the ends 23A of the elongated holes 23 of the supporting member 2 communicate with the recesses 33 of the holding member 3. However, since the cloth C is interposed between the holding member 3 and the supporting member 2, whether or not this positional relationship is achieved cannot be checked visually. According to the handicraft assisting tool 1, however, owing to the guiding function of the rotation preventing projections 22A, the proper positional relationship in which the ends 23A of the elongated holes 23 of the supporting member 2 communicate with the recesses 33 of the holding member 3 is established reliably. Then, the holding member 3 is pressed against the supporting member 2. As a result, as shown in FIG. 13, the holding member 3 is set to the supporting member 2, with the cloth C sandwiched between the two members. In this assembled state, the projections 32 of the holding member 3 engage the inner circumferential surface of the side plate 22 of the supporting member 2 via the cloth, whereby the holding member 3 is prevented from moving in the radial direction relative to the supporting member 2. Further, the rotation preventing mechanism A prevents the holding member 3 from turning in the circumferential direction relative to the supporting member 2. The lock mechanism B prevents the holding member 3 from moving in the thickness direction relative to the supporting member 2. Thus, in the assembled state, the holding member 3 is fixed to the supporting member 2, so that the cloth C does not move. As shown in FIG. 14, in the cloth C, a flat circular portion is defined by the projections 32 of the holding member 3, and the portion outside the circular portion is folded along the side plate 22 of the supporting member 2.

Then, with a seam allowance left, unnecessary portions of the cloth C are cut away. Herein, the cloth C may be cut at the folded portion generally along the upper edge of the side plate 22. By doing so, the cloth after the cutting has a seam allowance of a generally constant width and a circular shape suitable for making a yo-yo. In this embodiment, the cloth C is cut into a circular shape after sandwiched between the members 2 and 3. Instead of this, circular cloth with a certain seam allowance may be prepared in advance, and this cloth may be sandwiched between the holding member 3 and the supporting member 2.

Figure 15:
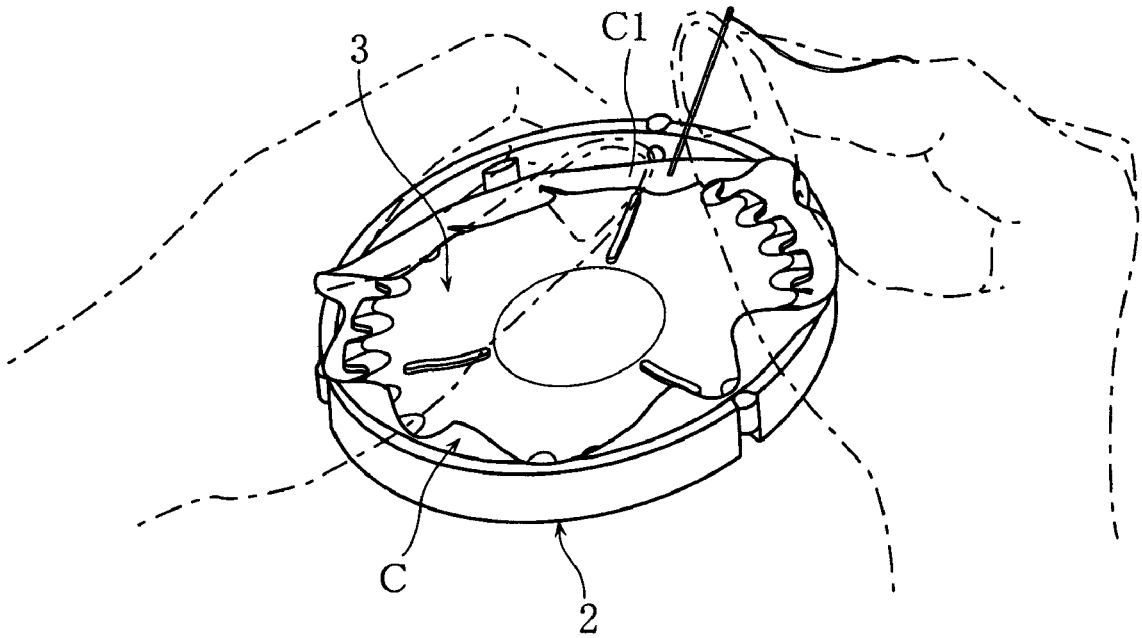
FIG. 15 is a perspective view showing the process of sticking a needle into the cloth from the holding member side.
Figure 16:
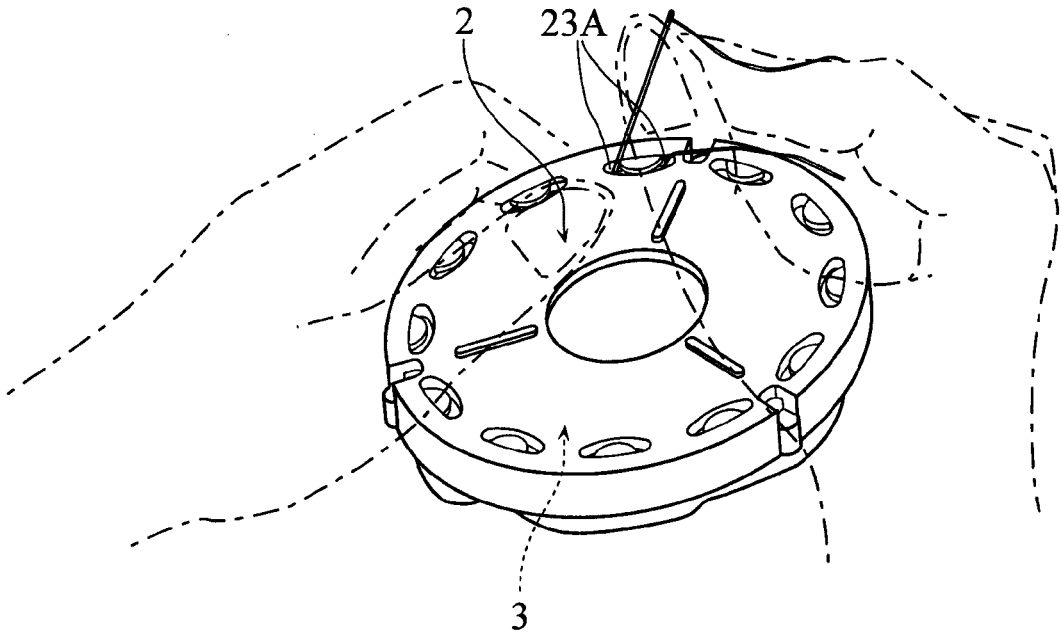
FIG. 16 is a perspective view showing the process of sticking a needle into the cloth from the supporting member side.

Then, the cloth C sandwiched between the supporting member 2 and the holding member 3 is sewn as follows. First, a knot is made at an end of the thread. Then, as shown in FIG. 15, from the holding member 3 side, the needle carrying the thread is stuck into one of the recesses 33 of the holding member 3 and the corresponding end 23A of the elongated hole 23 of the supporting member 2, whereby the needle passes through the seam allowance C1 and the portion of the cloth C sandwiched between the members 2 and 3. Then, the needle is pulled out to the supporting member 2 side. Then, as shown in FIG. 16, the needle is stuck into another end 23A of the elongated hole 23 and then into the corresponding recess 33 of the holding member 3. In this process, the needle passes through the portion of the cloth C sandwiched between the members 2 and 3 and the seam allowance. Then, the needle is pulled out to the holding member 3 side. These operations are repeated until the thread goes around the full circumference of the cloth C.

As noted before, the needle-guiding surfaces 31*c* are provided at the periphery of the holding member 3 (see FIG. 8). In sticking the needle from the holding member 3 side in the above-described sewing work, the portion (recess 33) into which the needle is to be stuck is covered with the cloth, so that the position cannot be visually determined. However, even when the position of the needle is slightly deviated from the recess 33, the needle is guided to the recess 33 by the needle-guiding surface 31*c*. Thus, the sewing is performed properly and efficiently.

As noted before, the ends 23A of the elongated holes 23 of the supporting member 2 are equally spaced from each other along a circle. Thus, uniform stitches are formed in the cloth C.

In the handicraft assisting tool 1, the lock mechanism B keeps the holding member 3 properly fitted to the supporting member 2. Thus, it is not necessary to continue to press the holding member 3 against the supporting member 2 by hand to keep the assembled state. As a result, the cutting of the cloth and sewing can be performed properly and easily.

Figure 17:
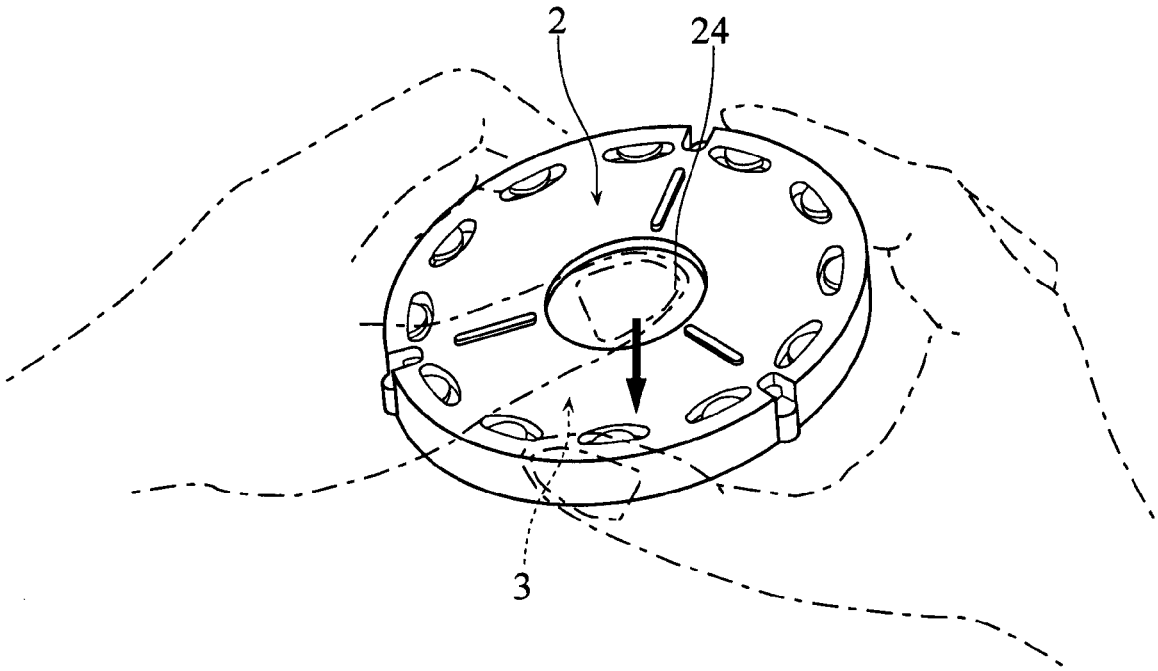
FIG. 17 is a perspective view showing the process of removing the holding member from the supporting member.

After the sewing is completed, the holding member 3 is removed from the supporting member 2. In this step, as shown in FIG. 17, the holding member 3 is pushed away from the supporting member 2 through the through-hole 24 of the supporting member 2. Thus, the holding member 3 is easily removed from the supporting member 2.

Figure 18:
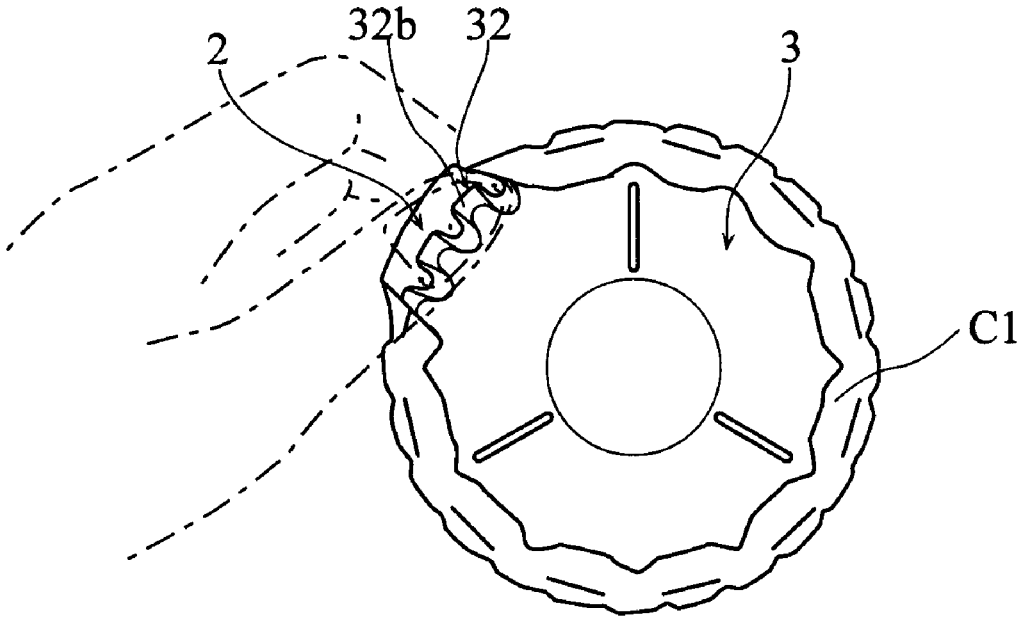
FIG. 18 shows the way of removing the cloth from the holding member.

Then, the cloth is removed from the holding member 3. Specifically, as shown in FIG. 18, the seam allowance C1 is held and disengaged from the projections 32. Since the projections 32 are formed with the inclined surfaces 32*b*, the removal of the cloth is easy.

Figure 19:
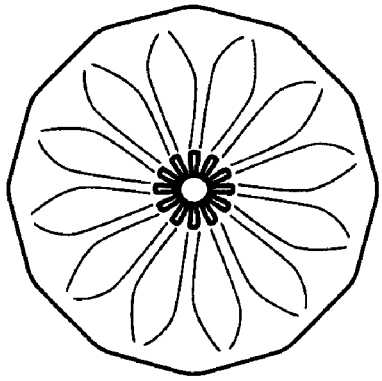
FIG. 19 is a plan view showing an example of quilt part made using the handicraft assisting tool according to the first embodiment.

In this way, a base product of yo-yo is obtained which has a generally circular shape with a folded edge and is sewed at the periphery. Then, the thread of the base product is pulled to gather the stitches and knotted. By subsequently adjusting the shape, the yo-yo as shown in FIG. 19 is obtained. As will be understood from the above description, by using the handicraft assisting tool 1, a yo-yo with a desired number and shape of gathers is formed easily and efficiently.

Figure 20:
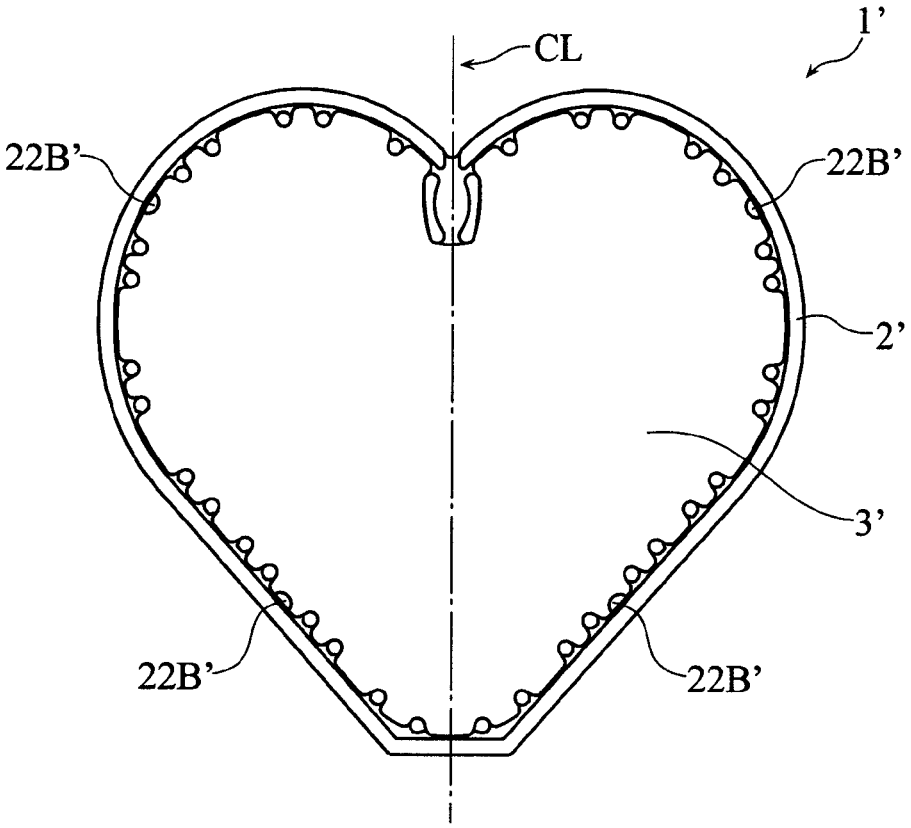
FIG. 20 is a plan view showing a handicraft assisting tool according to a second embodiment of the present invention.

FIG. 20 shows a handicraft assisting tool according to a second embodiment of the present invention. Unlike the first embodiment, the handicraft assisting tool 1' of this embodiment includes a heart-shaped supporting member 2' and a heart-shaped holding member 3'. As shown in the figure, the supporting member 2' is so designed as to accommodate the holding member 3' placed thereon. Each of the supporting member 2' and the holding member 3' is symmetrical with respect to the center line CL. Similarly to the first embodiment, in using the handicraft assisting tool 1', cloth is sandwiched between the supporting member 2' and the holding member 3'.

Figure 21:
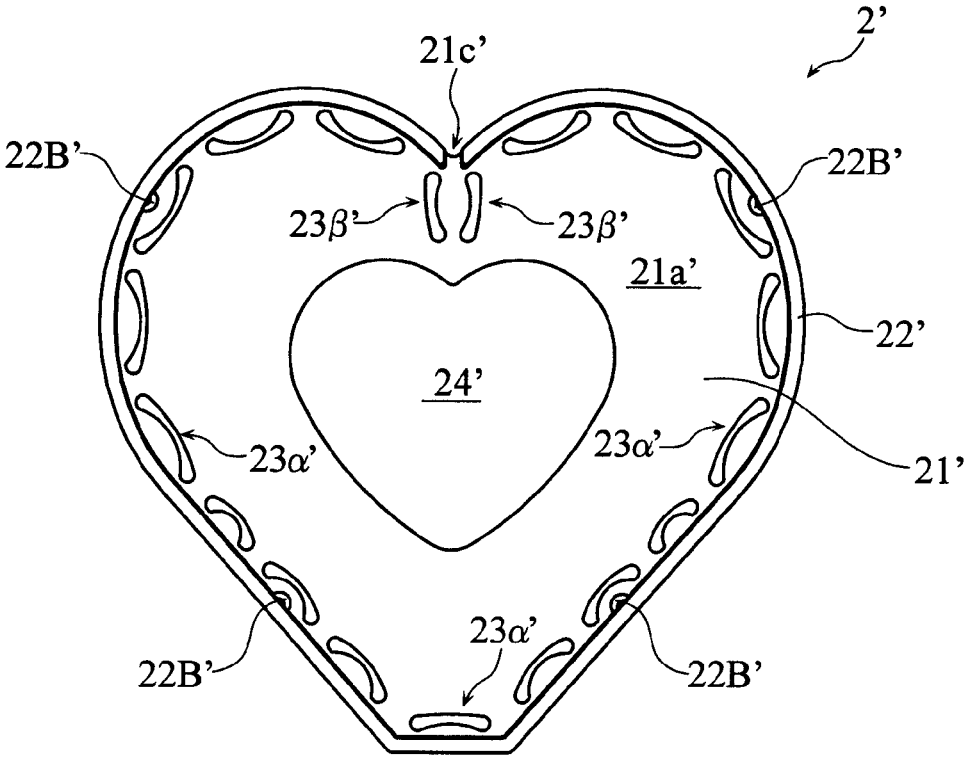
FIG. 21 is a plan view showing a supporting member of the handicraft assisting tool of the second embodiment.
Figure 22:
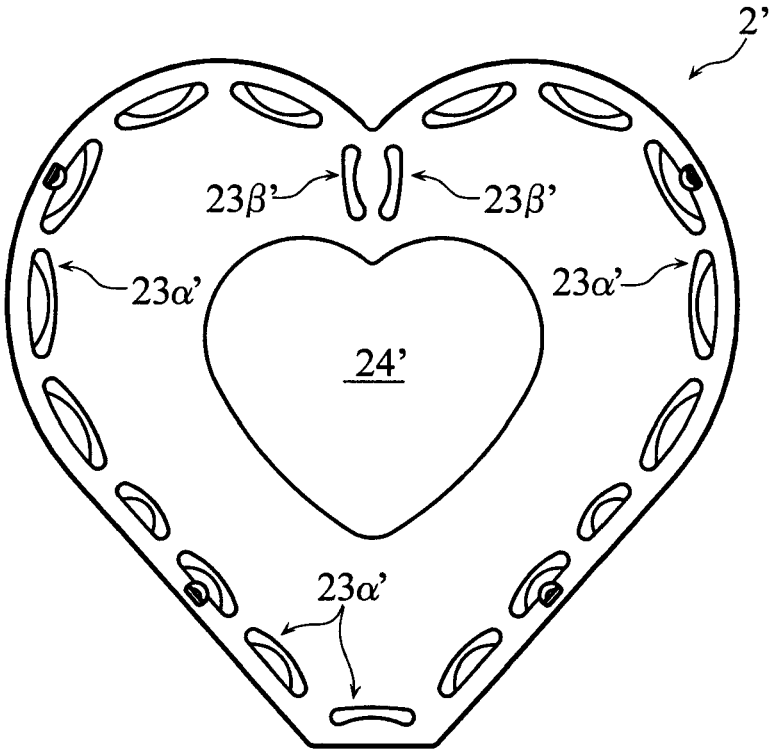
FIG. 22 shows the reverse surface of the supporting member shown in FIG. 21.

As shown in FIGS. 21 and 22, the supporting member 2' includes a heart-shaped main plate 21' and a side plate 22'. The main plate 21' and the side plate 22' are made of a synthetic resin such as polypropylene to be integral with each other. The main plate 21' has a flat inner surface 21*a'* on which the holding member 3' is to be placed. The side plate 22' extends along the periphery of the main plate 21'. The main plate 21' is formed with a plurality of elongated holes 23α', a pair of elongated holes 23β' and a through-hole 24'. The elongated holes 23α' are spaced from each other along the periphery of the main plate 21'. The paired elongated holes 23β' extend generally in parallel with each other between the recessed portion 21*c'* of the main plate 21' and the through-hole 24'. Although the through-hole 24' shown in the figures is heart-shaped, the through-hole may have another shape such as a circular shape. Similarly to the first embodiment, in the state in which the holding member 3' is placed on the supporting member 2', the holding member 3' can be pushed with a finger through the through-holes 24'.

The elongated holes 23α' may be arranged at regular intervals. Alternatively, the intervals between the elongated holes 23α' may vary partially. In the illustrated example, the elongated holes 23α' have different sizes depending on the positions in the main plate. However, the present invention is not limited to this, and all the elongated holes 23α' may have the same size. Similarly to the first embodiment, each of the elongated holes 23α' includes two ends and a middle portion connecting the two ends to each other. The elongated hole 23α' curves entirely so that the middle portion projects toward the through-hole 24'. Each end of the elongated hole 23α' is generally arcuate and has a dimension which allows smooth passing of a sewing needle. For instance, the diameter of the end may be about 2 mm. The paired elongated holes 23β' are arranged to be symmetrical with respect to the center line CL (see FIG. 20) and entirely curved. Similarly to the elongated holes 23α', each of the elongated holes 23β' has two generally arcuate ends having a diameter which allows smooth passing of a sewing needle.

As shown in FIG. 21, the inner circumferential surface of the side plate 22' is formed with a plurality of locking projections 22B'. Each of the locking projections 22B' projects from an intermediate portion of the side plate 22' in the height direction of the side plate. With this arrangement, similarly to the first embodiment, the holding member 3' is properly held by the supporting member 2' in using the handicraft assisting tool 1'.

Figure 23:
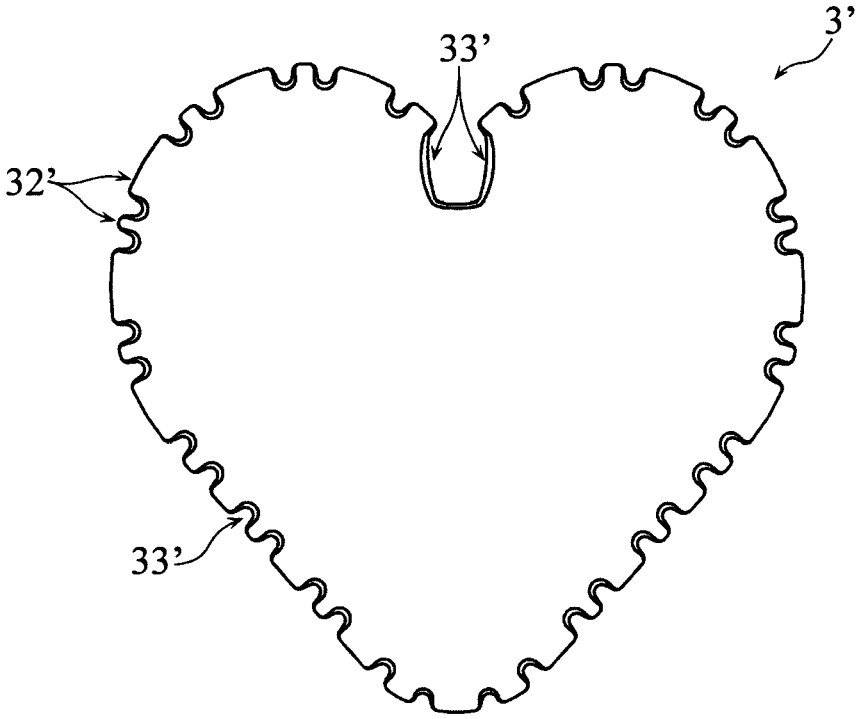
FIG. 23 is a plan view showing a holding member of the handicraft assisting tool of the second embodiment.

The holding member 3' of the second embodiment has the substantially same structure as the holding member 3 of the first embodiment except that the holding member 3' is heart-shaped and has some differences from the first embodiment to correspond to the shape. For instance, as shown in FIG. 23, the periphery of the holding member 3' is formed with a plurality of projections 32' and a plurality of recesses 33'. The projections 32' have different sizes and shapes depending on the positions.

The handicraft assisting tool 1' of the second embodiment does not require a mechanism corresponding to the rotation preventing mechanism A of the first embodiment, because the supporting member 2' and the holding member 3' to be used together with the supporting member are heart-shaped (more generally, non-circular). Similarly to the first embodiment, when the holding member 3' is properly set to the supporting member 2' (see FIG. 20), the ends of the elongated holes 23α', 23β' of the supporting member 2' communicate with the recesses 33' of the holding member 3'. The method for using the handicraft assisting tool 1' is basically the same as that of the first embodiment described with reference to FIGS. 15-18.

Figure 24:
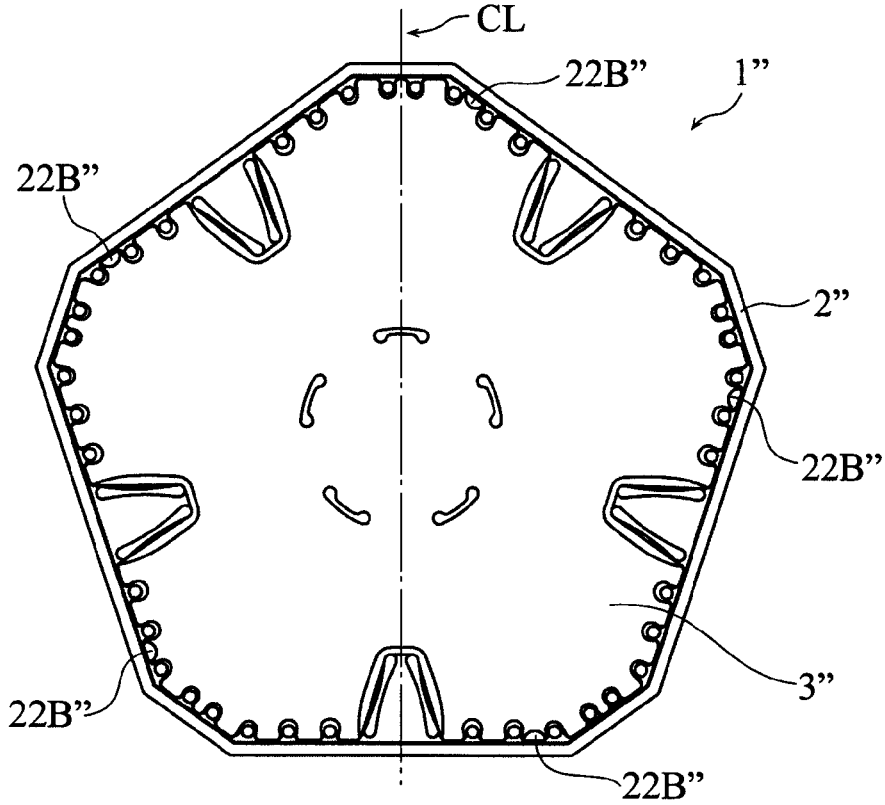
FIG. 24 is a plan view showing a handicraft assisting tool according to a third embodiment of the present invention.

FIG. 24 shows a handicraft assisting tool according to a third embodiment of the present invention. The handicraft assisting tool 1" includes a polygonal supporting member 2" and a holding member 3" having a shape and size corresponding to the supporting member. In the illustrated example, the polygon is made up of five longer sides of an equal length and five shorter sides extending between the longer sides. As shown in the figure, in the third embodiment again, the supporting member 2" is so designed as to support the holding member 3" placed thereon. The handicraft assisting tool 1", i.e., each of the supporting member 2" and the holding member 3" is symmetrical with respect to the center line CL. Similarly to the first embodiment, in using the handicraft assisting tool 1", cloth is sandwiched between the supporting member 2" and the holding member 3".

Figure 25:
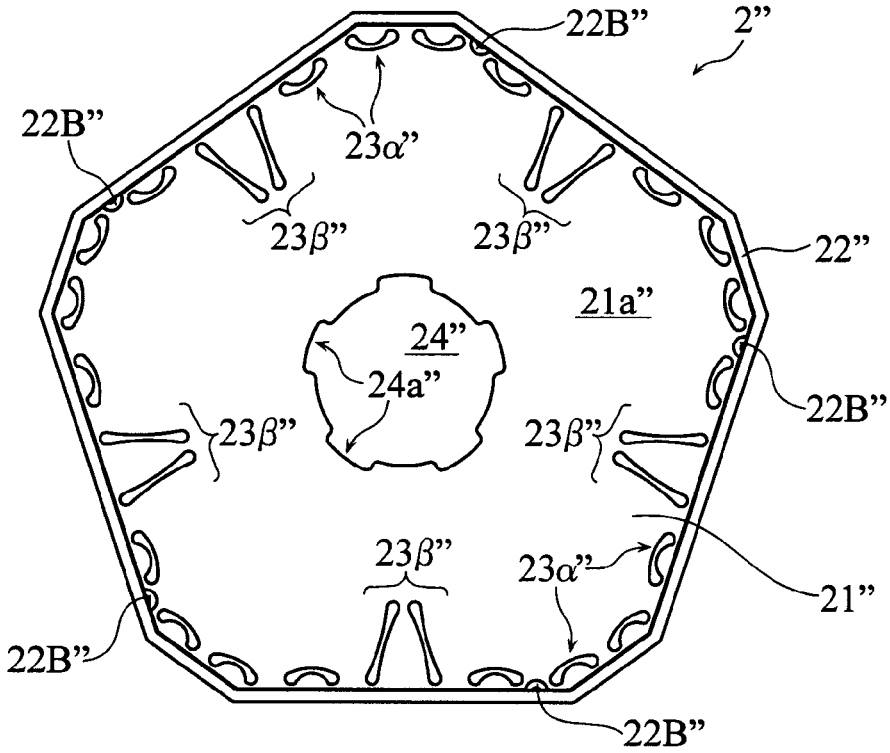
FIG. 25 is a plan view showing a supporting member of the handicraft assisting tool of the third embodiment.
Figure 26:
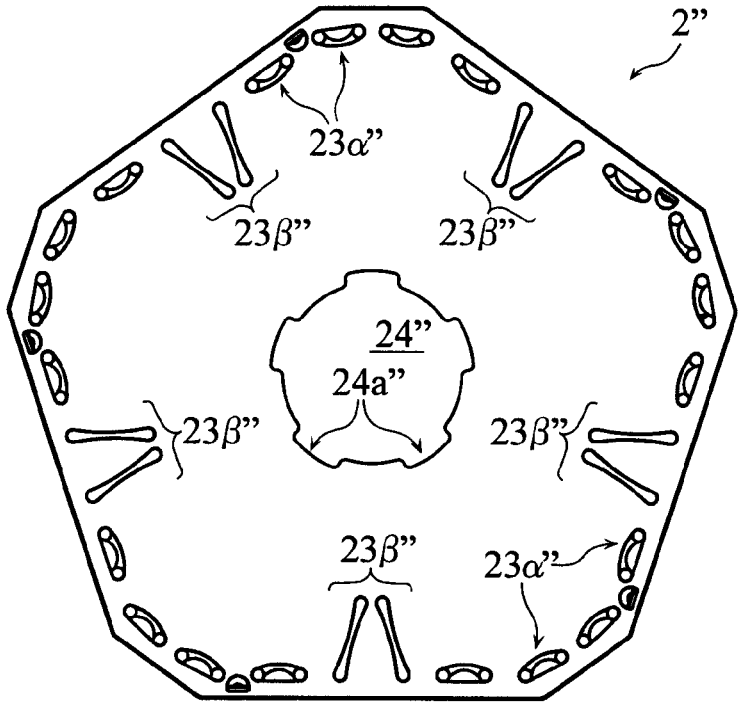
FIG. 26 shows the reverse surface of the supporting member shown in FIG. 25.

As shown in FIGS. 25 and 26, the supporting member 2" includes a main plate 21" and a side plate 22". The main plate 21" and the side plate 22" are made of a synthetic resin such as polypropylene to be integral with each other. The main plate 21" has a flat inner surface 21*a"* on which the holding member 3" is to be placed. The side plate 22" extends along the periphery of the main plate 21". The main plate 21" is formed with a plurality of elongated holes 23α", a plurality of pairs of elongated holes 23β" (five pairs in the illustrated example) and a through-hole 24". The elongated holes 23α" are spaced from each other along the periphery of the main plate 21". The elongated holes 23β" extend from portions adjacent to the longer sides of the main plate 21" toward the through-hole 24". The two elongated holes 23β" of each pair come close to each other as proceeding toward the through-hole 24". The through-hole 24" of the third embodiment is a generally circular hole formed with five retreated portions 24". The retreated portions 24" are equally spaced from each other in the circumferential direction. Each of the retreated portions 24" faces one of the shorter sides of the main plate 21. Similarly to the first embodiment, in the state in which the holding member 3" is placed on the supporting member 2", the holding member 3" can be pushed with a finger through the through-holes 24".

Similarly to the first embodiment, each of the elongated holes 23α" includes two ends and a middle portion connecting the two ends to each other. The elongated hole 23α" curves entirely so that the middle portion projects toward the through-hole 24". Each end of the elongated hole 23α" is generally arcuate and has a dimension which allows smooth passing of a sewing needle. For instance, the diameter of the end may be about 2 mm. Each of the elongated holes 23β" is generally straight and includes two ends for passing a needle and a middle portion connecting the two ends to each other.

As shown in FIG. 25, the inner surface of the side plate 22" is formed with a plurality of locking projections 22B". Each of the locking projections 22B" projects from an intermediate portion of the side plate 22" in the height direction of the side plate. With this arrangement, similarly to the first embodiment, the holding member 3" is properly held by the supporting member 2" in using the handicraft assisting tool 1".

Figure 27:
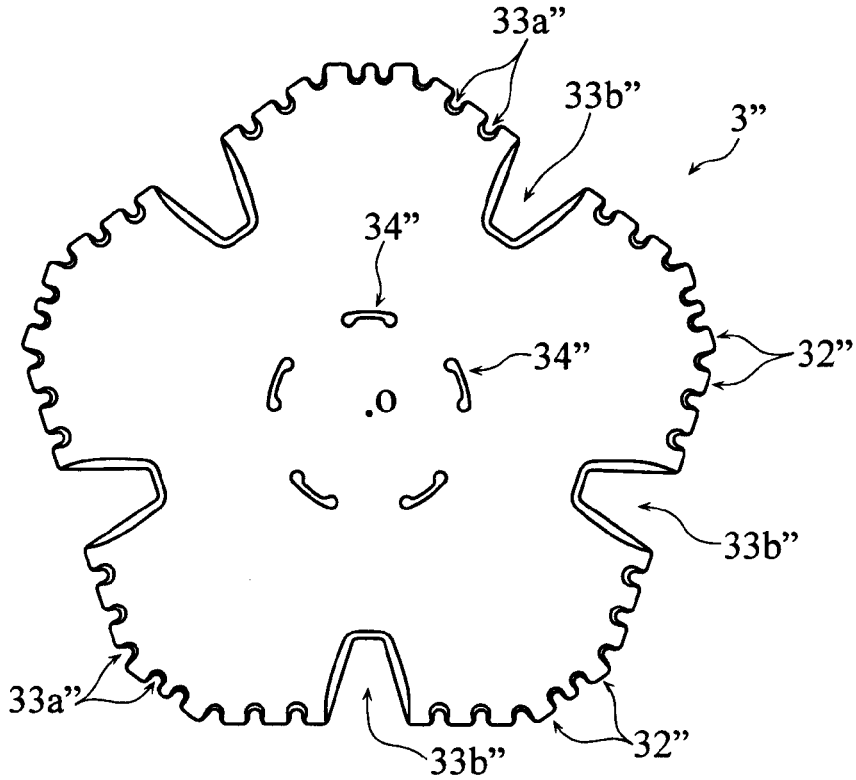
FIG. 27 is a plan view showing a holding member of the handicraft assisting tool of the third embodiment.

As shown in FIG. 27, the holding member 3" of the third embodiment is generally polygonal. The periphery of the holding member 3" is formed with a plurality of projections 32" and a plurality of recesses. The recesses include first recesses 33*a*" which are relatively shallow and second recesses 33*b*" which are relatively deep or large. The first recesses 33*a*" communicate with the elongated holes 23α" of the supporting member 2", whereas the second recesses 33*b*" communicate with the elongated holes 23β". The holding member 3" is further formed with a plurality of elongated holes 34". The elongated holes 34" are equally spaced from each other around the center O. Each of the elongated holes 34" includes two generally arcuate ends having a dimension which allows smooth passing of a sewing needle and a middle portion connecting the two ends to each other. When the holding member 3" is set to the supporting member 2" (see FIG. 24), the two ends of each elongated hole 34" communicate with one of the retreated portions 24" of the through-hole 24" of the supporting member 2".

As will be easily understood, the handicraft assisting tool 1" also does not require a mechanism corresponding to the rotation preventing mechanism A of the first embodiment. The method for using the handicraft assisting tool 1" is also basically the same as that of the first embodiment described with reference to FIGS. 15-18.

The shape of the handicraft assisting tool according to the present invention is not limited to the above-described three (circular, heart-shaped and polygonal shapes). For instance, the entirety of the handicraft assisting tool may be oval or configured otherwise.

The invention claimed is:

1. A handicraft assisting tool comprising:

a plate-like holding member; and a supporting member on which the holding member is placed;

wherein the supporting member includes: a main plate having a shape corresponding to the holding member, and a side plate standing from a periphery of the main plate in a thickness direction of the main plate, the main plate being formed with a plurality of elongated holes arranged along the periphery of the main plate and spaced from each other;

wherein the holding member includes a periphery formed with a plurality of recesses and a plurality of projections alternating with the recesses;

wherein each of the elongated holes includes opposite ends configured to communicate with corresponding ones of the recesses when the holding member is placed on the supporting member.

2. The handicraft assisting tool according to claim 1, wherein the side plate includes an inner circumferential surface formed with a rotation preventing projection protruding inwardly to engage a recess of the holding member to prevent rotation of the holding member relative to the supporting member.

3. The handicraft assisting tool according to claim 1, further comprising a movement preventer projecting inwardly from an inner circumferential surface of the side plate for preventing movement of the holding member relative to the supporting member in the thickness direction.

4. The handicraft assisting tool according to claim 1, wherein the periphery of the holding member is formed with a needle-guiding surface adjoining the recess.

5. The handicraft assisting tool according to claim 1, wherein each of the elongated holes includes a middle portion connecting the opposite ends to each other, the middle portion projecting radially inward of the supporting member.

6. The handicraft assisting tool according to claim 1, wherein the elongated holes are same in size, and wherein a distance between the opposite ends of each of the elongated holes is equal to a distance between adjacent ones of the elongated holes.

7. The handicraft assisting tool according to claim 1, wherein the supporting member is formed with a through-hole penetrating through a center of the supporting member in the thickness direction.

8. The handicraft assisting tool according to claim 1, wherein the periphery of the holding member is formed with an inclined surface, and wherein, when the holding member is placed on the supporting member, the inclined surface is so inclined as to come closer to the main plate of the supporting member as proceeding radially outward of the holding member.

9. The handicraft assisting tool according to claim 1, wherein the main plate of the supporting member is circular.

10. The handicraft assisting tool according to claim 1, wherein the main plate of the supporting member is non-circular.

11. A handicraft assisting tool comprising:

a plate-like holding member; and a supporting member in which the holding member is fitted;

wherein the supporting member includes: a main plate having a shape corresponding to the holding member, and a side plate standing from an entire periphery of the main plate in a thickness direction of the main plate, the main plate being formed with a plurality of elongated holes arranged along the entire periphery of the main plate and spaced from each other, the main plate and the side plate defining a holding space in which the holding member is fitted with the side plate surrounding the holding member;

wherein the holding member includes a periphery formed with a plurality of recesses;

wherein each of the elongated holes includes opposite ends configured to communicate with corresponding ones of the recesses when the holding member is fitted in the supporting member.

12. A handicraft assisting tool comprising:

a plate-like holding member; and a supporting member on which the holding member is placed;

wherein the supporting member includes: a main plate having a shape corresponding to the holding member; and a side plate standing from a periphery of the main plate in a thickness direction of the main plate, the main plate being formed with a plurality of elongated holes arranged along the periphery of the main plate and spaced from each other;

wherein the holding member includes a periphery formed with a plurality of recesses;

wherein each of the elongated holes includes opposite ends configured to communicate with corresponding ones of the recesses when the holding member is placed on the supporting member; and wherein the supporting member is formed with a through-hole penetrating through a center of the supporting member in the thickness direction.

* * * * *